US009153223B2

(12) United States Patent
Asao et al.

(10) Patent No.: US 9,153,223 B2
(45) Date of Patent: Oct. 6, 2015

(54) NOISE REDUCTION DEVICE

(71) Applicant: PANASONIC INTELLECTUAL PROPERTY MANAGEMENT CO., LTD., Osaka-shi (JP)

(72) Inventors: Yoshifumi Asao, Osaka (JP); Tsuyoshi Maeda, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 341 days.

(21) Appl. No.: 13/707,483

(22) Filed: Dec. 6, 2012

(65) Prior Publication Data

US 2013/0208906 A1 Aug. 15, 2013

(30) Foreign Application Priority Data

Feb. 9, 2012 (JP) ..... 2012-025771
Nov. 15, 2012 (JP) ..... 2012-251213

(51) Int. Cl.

| | |
|---|---|
| ***G10K 11/16*** | (2006.01) |
| ***H04R 1/02*** | (2006.01) |
| ***G10K 11/00*** | (2006.01) |
| ***G10K 11/178*** | (2006.01) |
| *H04R 5/02* | (2006.01) |

(52) U.S. Cl.

CPC ..... *G10K 11/002* (2013.01); *G10K 11/178* (2013.01); *G10K 2210/1281* (2013.01); *G10K 2210/1283* (2013.01); *G10K 2210/3211* (2013.01); *H04R 5/023* (2013.01)

(58) Field of Classification Search

None

See application file for complete search history.

(56) References Cited

U.S. PATENT DOCUMENTS

| | | | | |
|---|---|---|---|---|
| 5,133,017 | A * | 7/1992 | Cain et al. | 381/71.6 |
| 8,280,069 | B2 * | 10/2012 | Maeda et al. | 381/73.1 |
| 2008/0019536 | A1 * | 1/2008 | Marrot | 381/71.4 |
| 2010/0111317 | A1 * | 5/2010 | Asao et al. | 381/71.4 |
| 2011/0222699 | A1 * | 9/2011 | Maeda et al. | 381/71.4 |

FOREIGN PATENT DOCUMENTS

| | | | |
|---|---|---|---|
| JP | H7-160275 | A | 6/1995 |
| WO | WO-2009/078147 | A1 | 6/2009 |

* cited by examiner

*Primary Examiner* — Andrew L Sniezek
(74) *Attorney, Agent, or Firm* — Shinjyu Global IP

(57) ABSTRACT

A noise reduction device includes a noise controller, a control sound output component and a residual sound detector. The noise controller is configured to produce a control sound signal for canceling out noise. The control sound output component is configured to output a control sound based on the control sound signal produced by the noise controller. The residual sound detector is configured to detect a residual sound produced by superposition of noise and the control sound outputted from the control sound output component. The control sound output component and the residual sound detector are housed in the shell. The control sound output component and the residual sound detector are away from a rear face of the seat.

2 Claims, 10 Drawing Sheets

NOISE REDUCTION DEVICE

CROSS-REFERENCE TO RELATED APPLICATIONS

This application claims priority under 35 U.S.C. §119 to Japanese Patent Application No. 2012-025771 filed on Feb. 9, 2012, and to Japanese Patent Application No. 2012-251213 filed on Nov. 15, 2012. The entire disclosures of Japanese Patent Application No. 2012-025771 and to Japanese Patent Application No. 2012-251213 are hereby incorporated herein by reference.

BACKGROUND

1. Technical Field

The technology disclosed herein relates to a noise reduction device used in a seat in a sealed structure such as an aircraft or a railway car.

2. Background Information

When an internal space is utilized in which the boundaries are formed by continuous walls, such as in an aircraft or a vehicle, the utilized space becomes a kind of sealed structure, and if there is a noise source inside or outside the utilized space, the users of the space are stuck in a noisy environment.

Particularly with an aircraft, the main noise sources are noise from the machinery that generates the aircraft's thrust, such as propellers or engines, and wind noise as the aircraft nose and wings slice through the air during flight. Therefore, noise inside the cabin can be uncomfortable for the passengers, and also makes it harder to hear announcements and so forth, so there is a great need for improvement in this area.

In view of this, a method in which a noise reduction device is installed at each seat has been proposed to improve passenger comfort (see WO2009/078147 and Japanese Laid-Open Patent Application H7-160275, for example). This noise reduction device comprises a microphone that detects noise generated from a noise source, a controller that inverts the phase of and amplifies the output signal of the microphone, and a speaker that converts the output signal of the controller into sound.

SUMMARY

However, the microphone or speaker in Patent WO2009/078147 and Japanese Laid-Open Patent Application H7-160275 is disposed on the seat surface or inside the seat on which the user sits. Therefore, if the user uses a pillow while napping, for example, the pillow may hide the microphone or speaker. The microphone or speaker is particularly prone to being hidden by the pillow when the user is in a recumbent state in a seat that has a reclining mechanism.

It is an object of the technology disclosed herein to provide a noise reduction device capable of accurately attenuating noise.

A noise reduction device disclosed herein is used along with a shell that envelops at least part of a seat capable of supporting a user in a substantially lying posture. The noise reduction device includes a noise controller, a control sound output component and a residual sound detector. The noise controller is configured to produce a control sound signal for canceling out noise. The control sound output component is configured to output a control sound based on the control sound signal produced by the noise controller. The residual sound detector is configured to detect a residual sound produced by superposition of noise and the control sound outputted from the control sound output component. The control sound output component and the residual sound detector are housed in the shell. The control sound output component and the residual sound detector are away from a rear face of the seat.

With the noise reduction device disclosed herein, noise can be accurately attenuated.

BRIEF DESCRIPTION OF DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

An embodiment of the present invention will now be described through reference to the drawings.

Basic Principle Behind Noise Reduction

First, the basic principle by which noise is reduced will be described through reference to FIGS. 1 and 2. However, the noise reduction device 10 shown in FIGS. 1 and 2 is depicted for the purpose of illustrating the basic principle by which noise is reduced, and shows a conventional configuration. The configuration of the noise reduction device 100 pertaining to this embodiment will be described later, through reference to FIGS. 3 to 10.

Figures 1A, 1B, 1C:
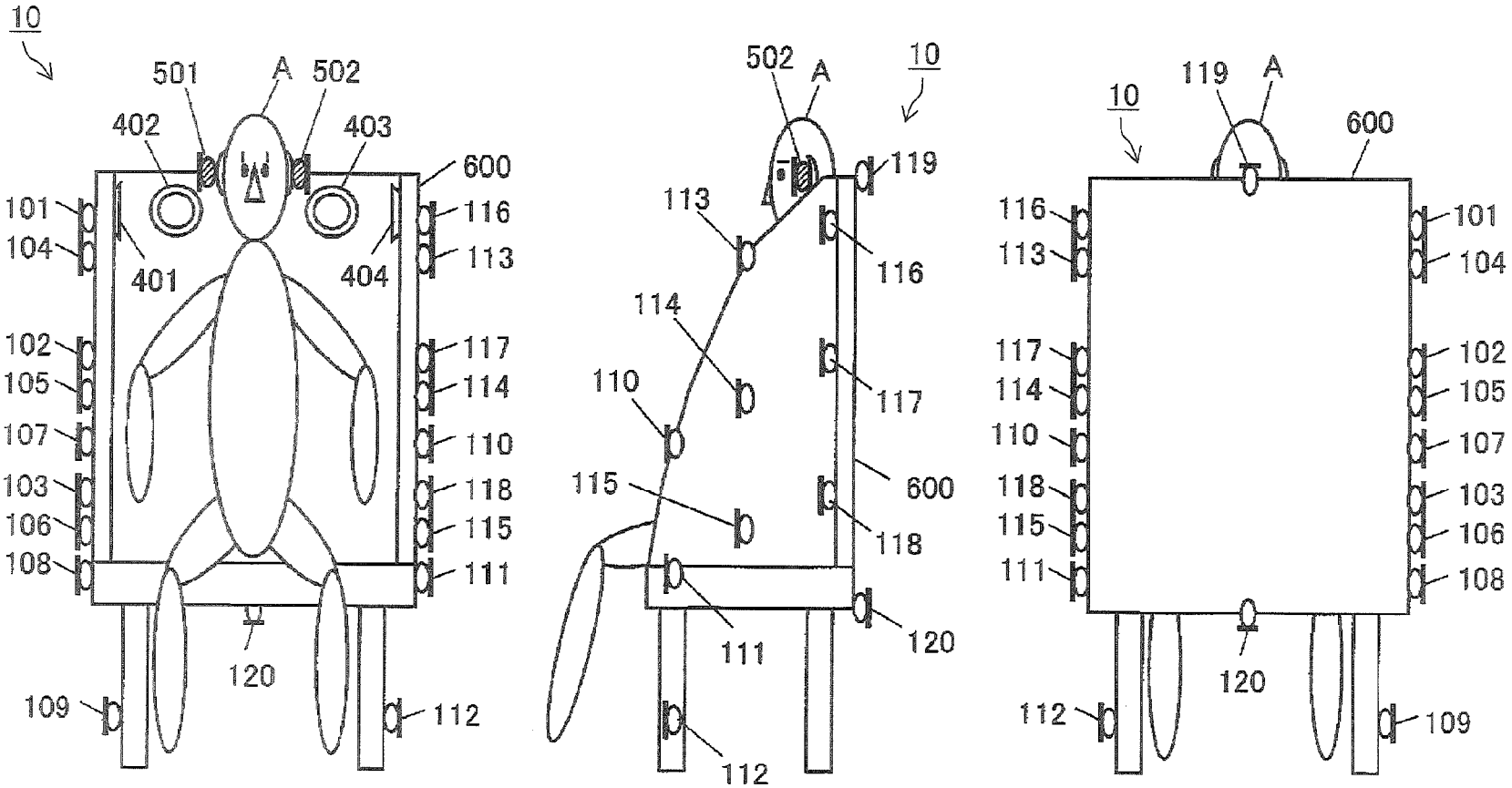
FIG. 1A, FIG. 1B and FIG. 1C are diagrams illustrating the basic principle whereby noise is reduced in a conventional noise reduction device.
Figure 2:
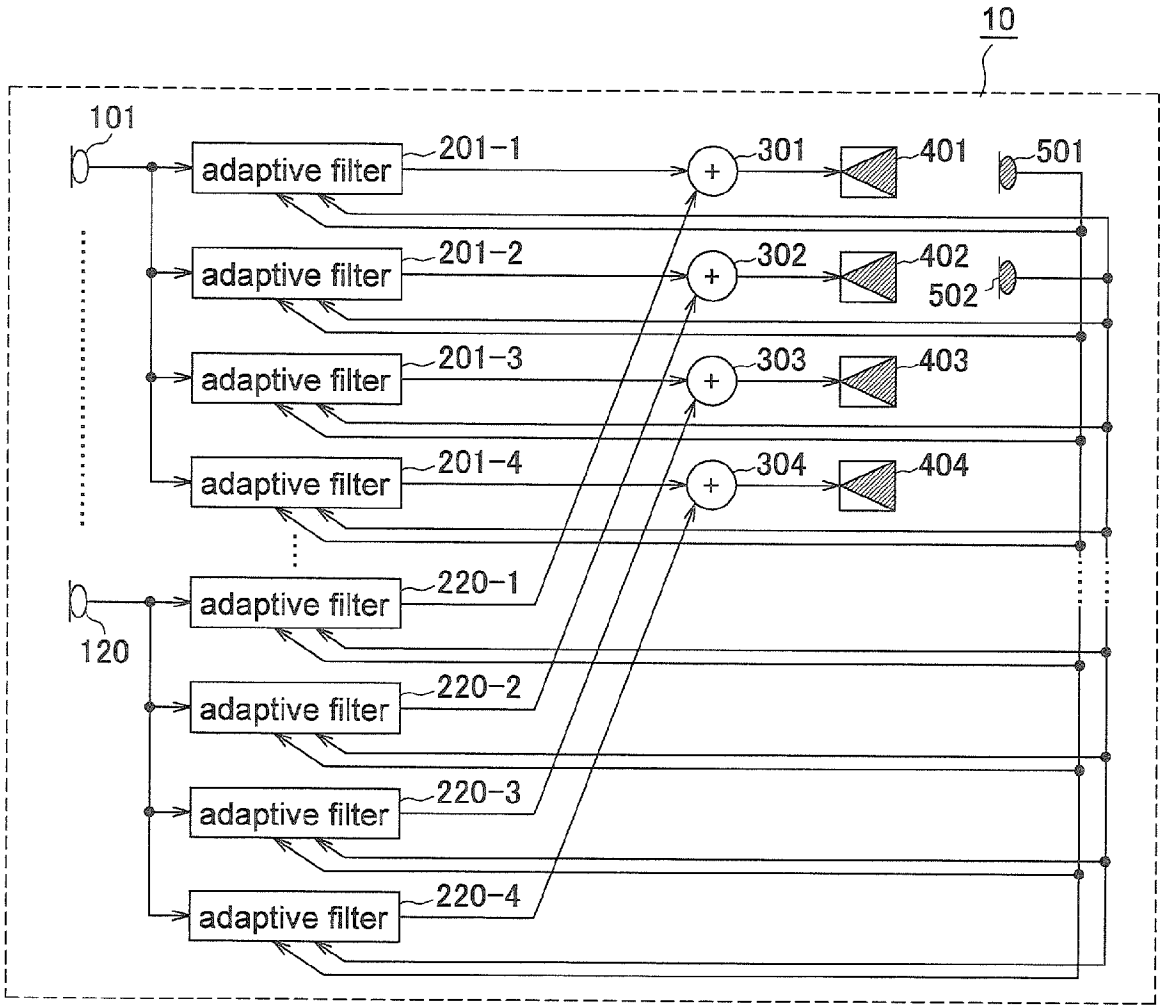
FIG. 2 is a block diagram of the basis circuit configuration of a conventional noise reduction device.

FIG. 1A is a front view of an aircraft seat 600 in which the conventional noise reduction device 10 has been installed. FIG. 1B is a side view of the seat 600. FIG. 1C is a rear view of the seat 600. FIG. 2 is a block diagram of the basis circuit configuration of the conventional noise reduction device 10 built into the seat 600.

As shown in FIG. 1, the noise reduction device 10 comprises noise detecting microphones 101 to 120, control speakers 401 to 404, and residual sound detecting microphones 501 and 502. The noise detecting microphones 101 to 120 detect noise coming from the outside, so they are installed on the outside of the seat 600. The control speakers 401 to 404 are installed at positions that are at substantially the same height as the ears of a user (passenger) A on the inside of the seat 600. The residual sound detecting microphones 501 and 502 are installed, for example, on the ears (control points) of the user A.

As shown in FIG. 2, the noise reduction device 10 comprises adaptive filters 201-1 to 220-1, 201-2 to 220-2, 201-3 to 220-3, and 201-4 to 220-4, and adders 301 to 304.

The operation of the noise reduction device 10 configured as above in noise reduction will now be described.

Noise detected by the noise detecting microphone 101 is outputted as a noise signal to the adaptive filters 201-1 to 201-4. Noise detected by the noise detecting microphone 102 is outputted as a noise signal to the adaptive filters 202-1 to 202-4 (not shown).

Similarly, noise detected by the noise detecting microphones 103 to 120 is outputted to the adaptive filters 203 (not shown) to 220.

A transmission function from the control speaker 401 to the residual sound detecting microphone 501, and a transmission function from the control speaker 401 to the residual sound detecting microphone 502 are preset by filtered-X_LMS method in the adaptive filter 201-1.

The adaptive filter 201-1 uses the preset transmission functions to update the filter coefficient of this filter so that the residual sound signals from the residual sound detecting microphones 501 and 502 are collectively minimized.

The residual sound detecting microphones 501 and 502 are installed at control points, and detect noise from a noise source that reaches a control point, and control sounds from the control speakers 401 to 404 that reach a control point. The residual sound detecting microphones 501 and 502 detect that noise reaching a control point is interfering with control sounds from the control speakers 401 to 404, and detect the difference between the noise and the control sounds as a residual sound signal.

Similarly, a transmission function from the control speaker 401 to the residual sound detecting microphone 501, and a transmission function from the control speaker 401 to the residual sound detecting microphone 502 are set in the adaptive filter 202-1 (not shown). The adaptive filter 202-1 uses the preset transmission functions to update the filter coefficient of this filter so that the residual sound signals from the residual sound detecting microphones 501 and 502 are collectively minimized.

Similarly, a transmission function from the control speaker 401 to the residual sound detecting microphone 501, and a transmission function from the control speaker 401 to the residual sound detecting microphone 502 are set in the adaptive filter 203-1 (not shown). The adaptive filter 203-1 uses the preset transmission functions to update the filter coefficient of this filter so that the residual sound signals from the residual sound detecting microphones 501 and 502 are collectively minimized.

Also, a transmission function from the control speaker 402 to the residual sound detecting microphone 501, and a transmission function from the control speaker 402 to the residual sound detecting microphone 502 are set in the adaptive filters 201-2 to 220-2. The adaptive filters 201-2 to 220-2 use the preset transmission functions to update the filter coefficient of the respective filters so that the residual sound signals from the residual sound detecting microphones 501 and 502 are collectively minimized.

Also, a transmission function from the control speaker 403 to the residual sound detecting microphone 501, and a transmission function from the control speaker 403 to the residual sound detecting microphone 502 are set in the adaptive filters 201-3 to 220-3. The adaptive filters 201-3 to 220-3 use the preset transmission functions to update the filter coefficient of the respective filters so that the residual sound signals from the residual sound detecting microphones 501 and 502 are collectively minimized.

Also, a transmission function from the control speaker 404 to the residual sound detecting microphone 501, and a transmission function from the control speaker 404 to the residual sound detecting microphone 502 are set in the adaptive filters 201-4 to 220-4. The adaptive filters 201-4 to 220-4 use the preset transmission functions to update the filter coefficient of the respective filters so that the residual sound signals from the residual sound detecting microphones 501 and 502 are collectively minimized.

The adaptive filters 201-1 to 220-1 use the updated filter coefficients to perform signal processing on the inputted noise signals, and output the results as control signals to the adder 301. The adder 301 adds up the control signals from the adaptive filters 201-1 to 220-1, and outputs the results to the control speaker 401. The control speaker 401 outputs a control sound based on the control signal from the adder 301, toward the residual sound detecting microphones 501 and 502, which are control points.

The adaptive filters 201-2 to 220-2 use the updated filter coefficients to perform signal processing on the inputted noise signals, and output the results as control signals to the adder 302. The adder 302 adds up the control signals from the adaptive filters 201-2 to 220-2, and outputs the results to the control speaker 402. The control speaker 402 outputs a control sound based on the control signal from the adder 302, toward the residual sound detecting microphones 501 and 502, which are control points.

The adaptive filters 201-3 to 220-3 use the updated filter coefficients to perform signal processing on the inputted noise signals, and output the results as control signals to the adder 303. The adder 303 adds up the control signals from the adaptive filters 201-3 to 220-3, and outputs the results to the control speaker 403. The control speaker 403 outputs a control sound based on the control signal from the adder 303, toward the residual sound detecting microphones 501 and 502, which are control points.

The adaptive filters 201-4 to 220-4 use the updated filter coefficients to perform signal processing on the inputted noise signals, and output the results as control signals to the adder 304. The adder 304 adds up the control signals from the adaptive filters 201-4 to 220-4, and outputs the results to the control speaker 404. The control speaker 404 outputs a control sound based on the control signal from the adder 304, toward the residual sound detecting microphones 501 and 502, which are control points.

The update processing of the filter coefficients discussed above allows the noise reduction device 10 installed in the seat 600 to reduce noise that reaches the ears (control points) of the user A.

In this example, if there is almost no change in the frequency and/or the level of noise, or if there is fluctuation within a certain range, then a noise reduction effect that is the same as when noise is controlled with adaptive filters can be achieved by performing noise control with just fixed filters having a fixed filter frequency, instead of adaptive filters.

Functional Configuration of Noise Reduction Device 100

Next, the functional configuration of the noise reduction device 100 pertaining to this embodiment will be described through reference to FIG. 3. The external configuration of the noise reduction device 100 will be described later, through reference to FIG. 7.

Figure 3:
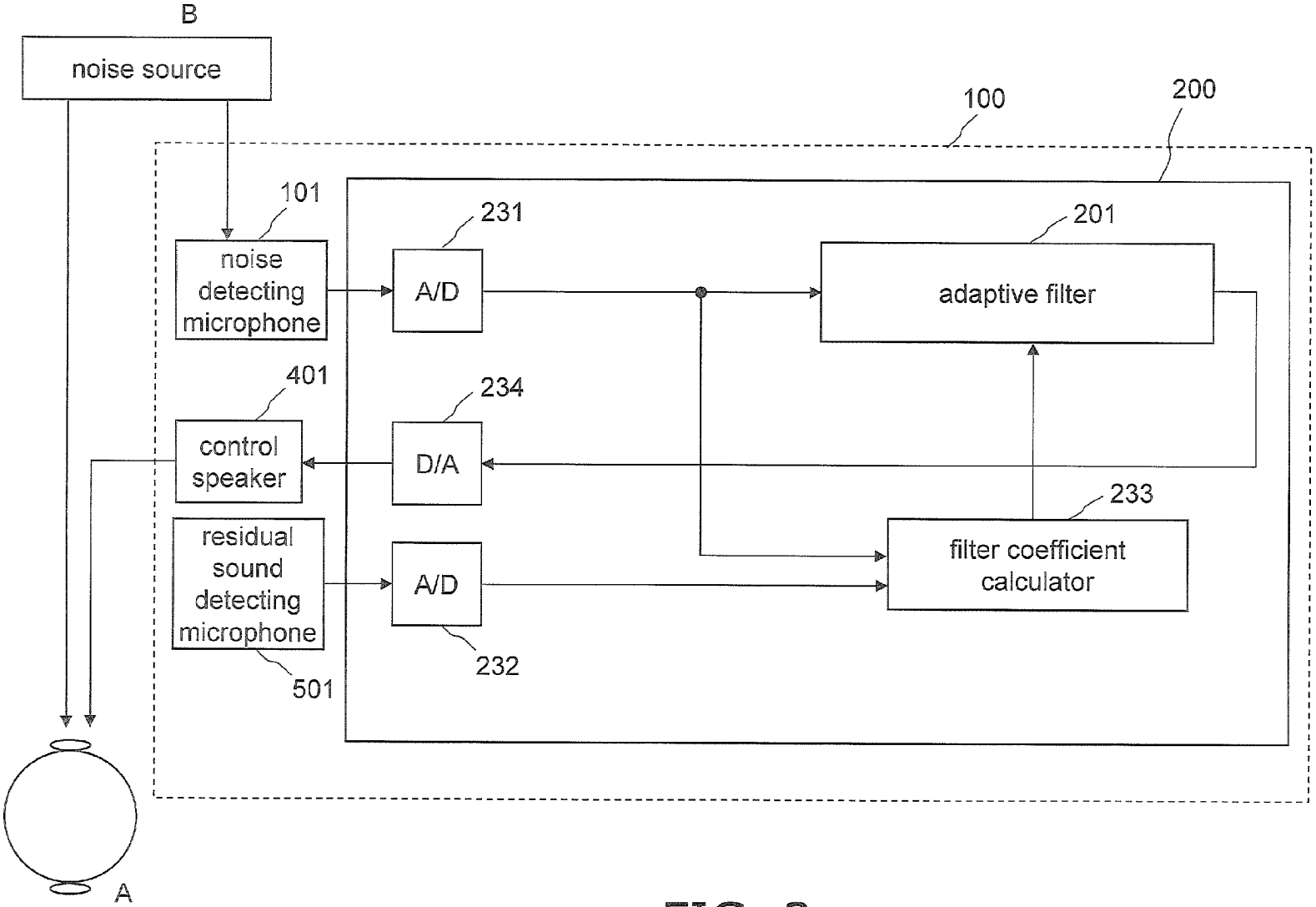
FIG. 3 is a block diagram of the noise reduction device pertaining to an embodiment.

FIG. 3 is a block diagram of the basic circuit configuration of the noise reduction device 100 in this embodiment. As shown in FIG. 3, the noise reduction device 100 comprises a noise detecting microphone 101, a noise controller 200, a control speaker 401, and a residual sound detecting microphone 501. The various components and their functions will now be described.

The noise reduction device 100 pertaining to this embodiment comprises two sets of noise detecting microphone, noise controller, control speaker, and residual sound detecting microphone (see FIG. 7), but since the paired members have substantially the same configuration, just one set is depicted in the drawings and will be described here.

The noise detecting microphone 101 is an example of a noise detector that detects noise emitted from a noise source B. More specifically, the noise detecting microphone 101 is a microphone that has the function of detecting noise, converting it into an electrical signal, and outputting this signal.

The noise controller 200 is an example of a noise controller. The noise controller 200 comprises A/D converters 231 and 232, an adaptive filter 201, a filter coefficient calculator 233, and a D/A converter 234. The noise controller 200 controls the control speaker 401 and produces control signals so that the residual sound detected by the residual sound detecting microphone 501 is minimized, based on a residual sound signal from the residual sound detecting microphone 501 and a noise signal from the noise detecting microphone 101.

The A/D converter 231 subjects the noise signal from the noise detecting microphone 101 to A/D conversion, and outputs the result to the adaptive filter 201 and the filter coefficient calculator 233.

The adaptive filter 201 is an FIR (finite impulse response) filter that is made up of multistage tap and that allows the filter coefficient of each tap to be set as desired.

The detected residual sound signal received from the residual sound detecting microphone 501 is inputted through the A/D converter 232, along with information received from the noise detecting microphone 101, to the filter coefficient calculator 233. The filter coefficient calculator 233 adjusts the filter coefficients of the adaptive filter 201 so that this detected residual sound will be minimized.

Specifically, a control sound signal is produced so that the phase will be the opposite of that of the noise from the noise source at the location where the residual sound detecting microphone 501 is installed, and this signal is outputted through the D/A converter 234 to the control speaker 401.

The control speaker 401 is an example of a control sound output component. The control speaker 401 can convert a control sound signal received from the D/A converter 234 into a sound wave and output it. Specifically, the control speaker 401 has the function of emitting a control sound that cancels out noise in the vicinity of the ear of the user A.

The residual sound detecting microphone 501 is an example of a residual sound detector. The residual sound detecting microphone 501 detects sound that has undergone noise reduction as residual sound, and performs feedback on the operating result of the noise reduction device 100. This allows noise always to be minimized at a location near the ear of the user A even if the noise environment or the like should change.

As shown in FIG. 3, the noise reduction device 100 in this embodiment uses the noise detecting microphone 101 to detect noise emitted from a noise source, uses the noise controller 200 to perform signal processing, and outputs a control sound from the control speaker 401. Thus, noise is reduced by superposing sound of the inverted phase on noise emitted from a noise source, and emitting the resulting sound at the ears of the user A.

Verification of Noise Reduction Effect Obtained with Noise Reduction Device 100

Next, the relation between the noise reduction effect and the difference in distance between the user A and the residual sound detecting microphone 501 will be described through reference to FIGS. 4 to 6.

In general, when a control sound of the same amplitude and reverse phase is superposed with a noise, the noise and the control sound cancel each other out, resulting in zero energy. However, if the phase of the control sound deviates by $\lambda/6$ ($\lambda$ is the wavelength of the noise in question) from the reverse phase with respect to the noise, the energy of the two superposed waves will be equal to the energy of the original noise, and no noise reduction effect will be obtained. The result of verifying this by simulation is shown in FIG. 4.

Figure 4A:
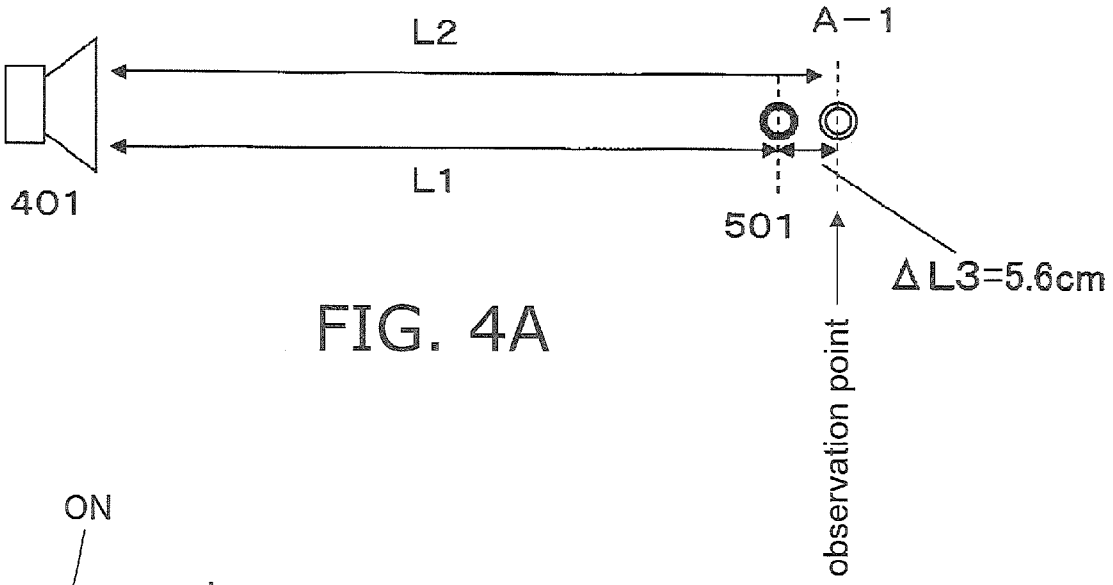
FIG. 4A and FIG. 4B are simulation diagrams for verifying the noise reduction effect of the noise reduction device pertaining to an embodiment.

FIG. 4A shows the simulation conditions. L1 (an example of a first distance) is the distance between the control speaker 401 and the residual sound detecting microphone 501. L2 (an example of a second distance) is the distance from the control speaker 401 to the ear A-1 of the user A. $\Delta L3$ ($=|L1-L2|$; an example of the difference between the first distance and the second distance) is the distance between the residual sound detecting microphone 501 and the ear A-1 of the user A. If we assume that the residual sound detecting microphone 501 and the user A are sufficiently far away from the control speaker 401 ($L1, L2 >> \Delta L3$), then $L1 \approx L2$, and the control sounds that reach the control speaker 401 and the residual sound detecting microphone 501 can be considered to have the same amplitude.

In simulation, we let $L1=L2>>\Delta L3$ and $\Delta L3=5.6$, and calculated the noise reduction effect at the ear A-1 of the user A when the noise reduction effect was optimized at the point of the residual sound detecting microphone 501. This result is shown in FIG. 4B.

Figure 4B:
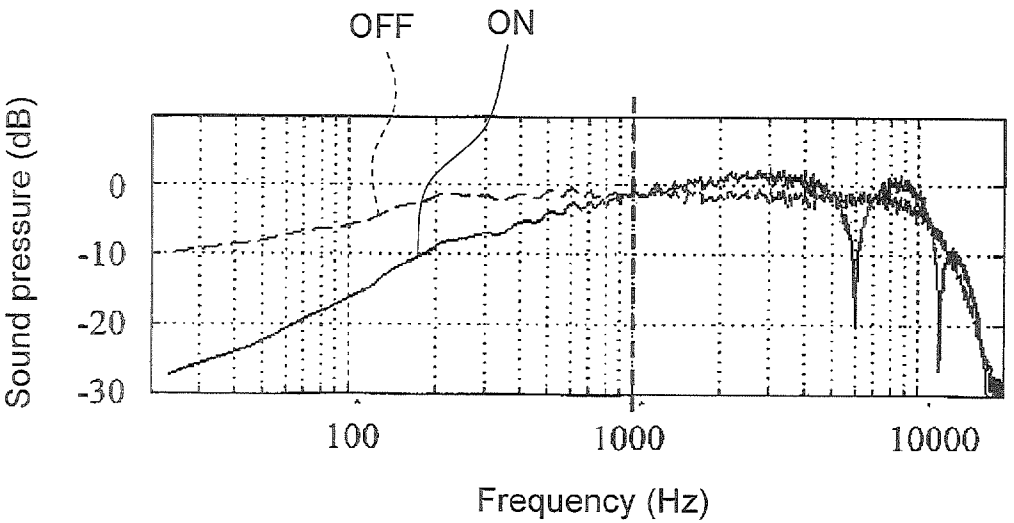

FIG. 4B shows the noise frequency characteristics at the ear A-1 of the user. In FIG. 4B, the broken line shows the frequency characteristics when noise reduction is off, and the solid line shows the frequency characteristics when noise reduction is on. It can be seen from the graph in FIG. 4B that a noise reduction effect becomes more difficult to obtain at 1000 Hz and above. From this result we can conclude that the relationship $\Delta L3=V/(6\times f)$ holds true between the distance $\Delta L3$ (meters) from the ear A-1 of the user to the residual sound detecting microphone 501, the limit frequency f (Hz) which a noise reduction effect is obtained, and the speed of sound V (=340 meters per second). As shown in FIG. 4B, the limit frequency f (Hz) which a noise reduction effect is obtained is the frequency that passes through the first intersection between the broken line indicating the noise when noise reduction is off and the solid line indicating the noise when noise reduction is on.

Thus, to obtain a noise reduction effect up to at least the desired limit frequency f (Hz), it can be seen that the residual sound detecting microphone 501 should be installed within a range of distance of $\Delta L3=V/(6\times f)$ from the ear A-1 of the user.

Up to now, we have given the results of a simulation conducted under the assumption that the residual sound detecting microphone 501 and the user A were located sufficiently far away from the control speaker 401, and that $L1 \approx L2$, so the control sounds reaching the residual sound detecting microphone 501 and the user A can be considered to have the same amplitude. However, in actual practice, the volume of the control sounds reaching the residual sound detecting microphone 501 and the user A have an amplitude difference large enough that it cannot be ignored, due to problems of the law of causality and the output limit of the control speaker 401.

In view of this, the result of an experiment conducted by taking the actual amplitude difference into account will be described through reference to FIGS. 5 and 6. In this experiment, the noise amplitude is set to be substantially the same at all locations of the residual sound detecting microphone 501 and the ear A-1 of the user A.

The noise reduction effect in a state in which the user A is farther away from the control speaker 401 than the residual sound detecting microphone 501 is (L1<L2) will be described through reference to FIG. 5.

Figure 5A:
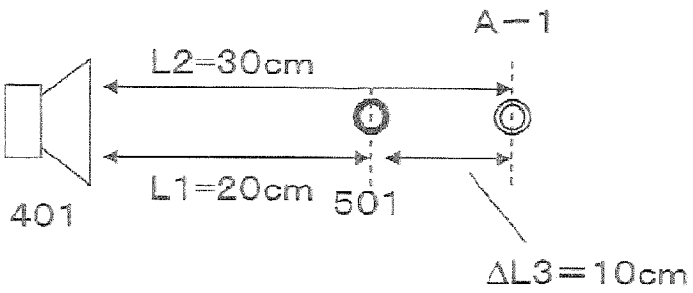
FIG. 5A and FIG. 5B are experiment diagrams for verifying the noise reduction effect of the noise reduction device pertaining to an embodiment.

FIG. 5A shows the experiment conditions. In FIG. 5A, the distance L1 between the control speaker 401 and the residual sound detecting microphone 501 is 20 cm, and the distance L2 between the control speaker 401 and the ear A-1 of the user is 30 cm. Therefore, the distance ΔL3 between the residual sound detecting microphone 501 and the ear A-1 of the user (=|L1−L2|) is 10 cm.

Figure 5B:
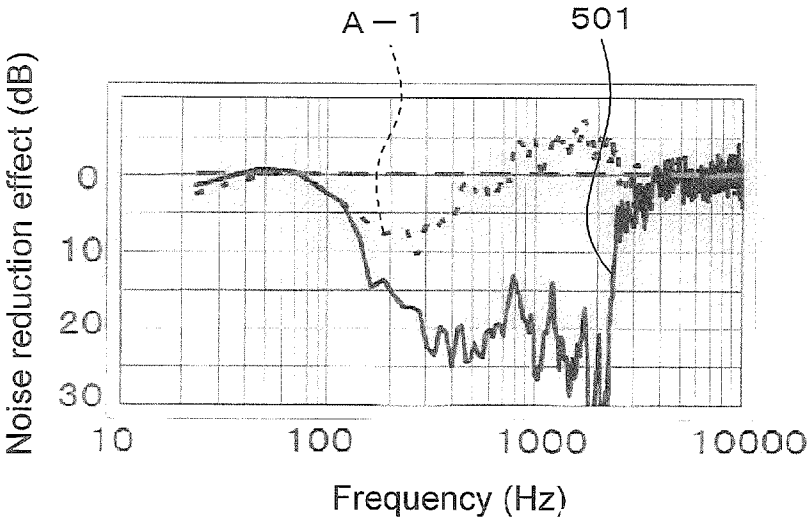

FIG. 5B shows the noise reduction effect here. In FIG. 5B, the solid line is the noise reduction effect at the residual sound detecting microphone 501, and the dotted line is the noise reduction effect at the ear A-1 of the user. As can be seen from this graph, a noise reduction effect at close to 700 Hz is obtained at the ear A-1 of the user.

Since ΔL3=10 (cm) here, if there is no change in the amplitude of the control sound, a noise reduction effect should only be obtained up to the 567 Hz calculated from the formula f=V/(6×ΔL3) obtained from the simulation result discussed above. Actually, however, since the control sound is attenuated by the time it reaches the ear A-1 of the user A, there is less effect of phase deviation, and as a result the limit frequency f (Hz) at which a noise reduction effect is obtained has shifted toward the higher frequency side, from 567 Hz to 700 Hz.

Next, the noise reduction effect when the user A is farther away from the control speaker 401 than the residual sound detecting microphone 501 is will be described through reference to FIG. 6.

Figure 6A:
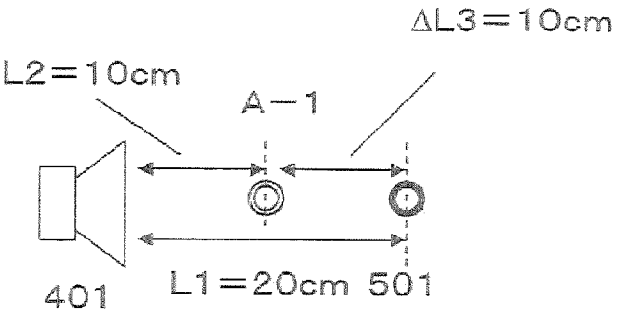
FIG. 6A and FIG. 6B are experiment diagrams for verifying the noise reduction effect of the noise reduction device pertaining to an embodiment.

FIG. 6A shows the experiment conditions. In FIG. 6A, the distance L1 between the control speaker 401 and the residual sound detecting microphone 501 is 20 cm, and the distance L2 between the control speaker 401 and the ear A-1 of the user is 10 cm. Therefore, the distance ΔL3 between the residual sound detecting microphone 501 and the ear A-1 of the user (=|L1−L2|) is 10 cm.

Figure 6B:
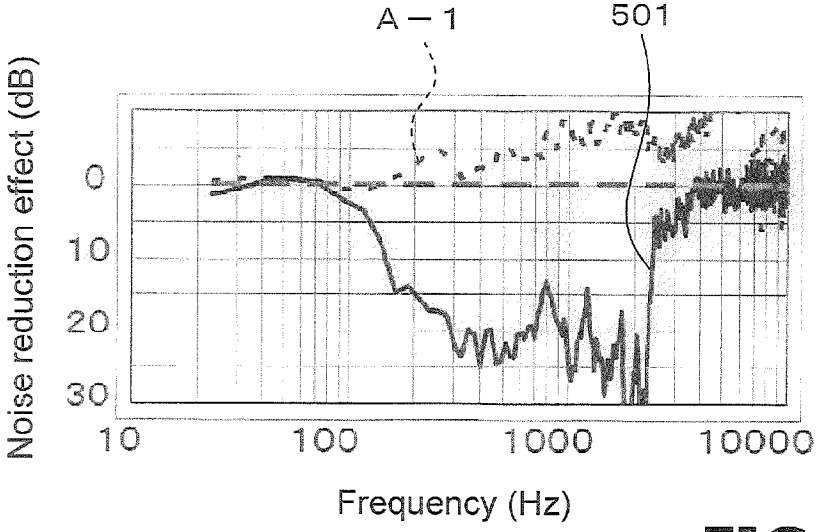

The noise reduction effect here is shown in FIG. 6B. The solid line in FIG. 6B is the noise reduction effect at the residual sound detecting microphone 501, and the dotted line is the noise reduction effect at the ear A-1 of the user. As can be seen from this graph, a noise reduction effect over substantially the entire frequency band is not obtained at the ear A-1 of the user.

Since ΔL3=10 (cm) here, if there is no change in the amplitude of the control sound, a noise reduction effect should only be obtained up to the 567 Hz calculated from the formula f=V/(6×ΔL3) obtained from the simulation result discussed above. Actually, however, since the ear A-1 of the user is closer to the control speaker 401 than the residual sound detecting microphone 501 is, the amplitude of the control sound is greater than the amplitude of the noise, and as a result this leads to an increase in noise.

It can be seen from the above that when it comes to the layout of the control speaker 401, the residual sound detecting microphone 501, and the user A, it is necessary to satisfy two conditions, namely, (1) ΔL3=V/(6×f) and (2) L1≤L2, in order to obtain a good noise reduction effect at least up to the desired frequency f (Hz).

External Configuration of Noise Reduction Device 100

Figures 7A, 7B, 7C:
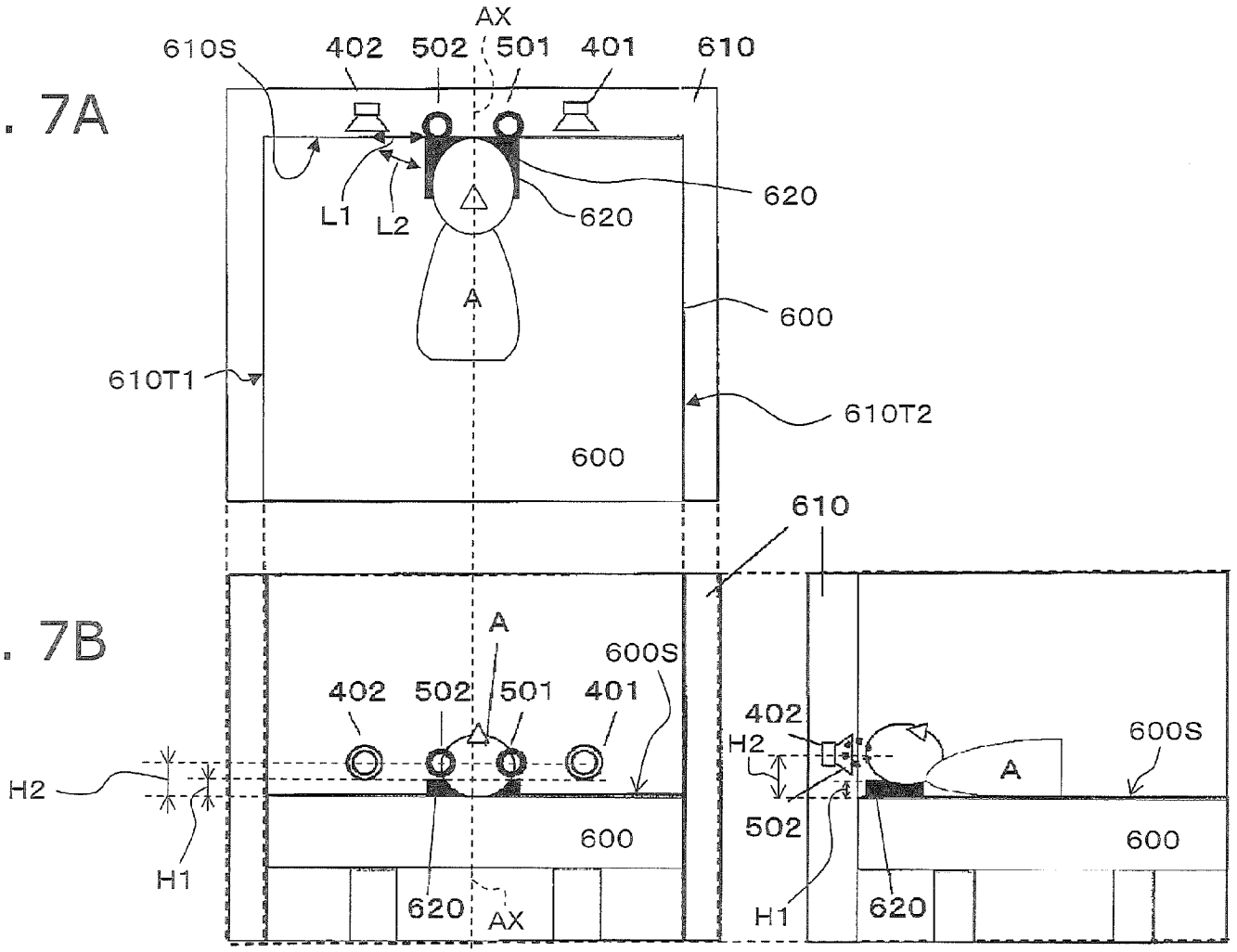
FIG. 7A, FIG. 7B and FIG. 7C are diagrams of the configuration of the noise reduction device pertaining to an embodiment.

Next, the external configuration of the noise reduction device 100 will be described through reference to FIGS. 7*a* to 7*c*. FIGS. 7*a* to 7*c* show examples of using two pairs of control speaker and residual sound detecting microphone. FIG. 7A is a plan view of the noise reduction device 100. FIG. 7B is a front view of the noise reduction device 100. FIG. 7C is a side view of the noise reduction device 100. In FIGS. 7*a* to 7*c*, the seat 600 has been put in a recumbent position, which makes it easier for the user A to sleep.

As shown in FIGS. 7*a* to 7*c*, the control speakers 401 and 402 and the residual sound detecting microphones 501 and 502 are disposed inside a shell 610. In this embodiment, the control speakers 401 and 402 and the residual sound detecting microphones 501 and 502 are housed on the inside of the inner top face 610S of the shell 610.

Also, as shown in FIGS. 7*a* and 7*b*, the control speakers 401 and 402 are disposed uniformly on the left and right, using the center line AX indicating the width direction center of the noise reduction device 100 as a reference. Similarly, the residual sound detecting microphones 501 and 502 are disposed uniformly on the left and right, using the center line AX of the noise reduction device 100 as a reference. Also, the control speakers 401 and 402 are disposed more to the outside than the residual sound detecting microphones 501 and 502, using the center line AX of the noise reduction device 100 as a reference.

In this embodiment, the center line AX of the noise reduction device 100 passes through the center of a first inner face 610T1 and a second inner face 610T2 of the shell 610, but is not limited to doing so. As long as it passes through the center at the left and right ends of the shell 610, the center line AX need not have a configuration and shape that are in left and right symmetry around the center line AX.

The control speakers 401 and 402 and the residual sound detecting microphones 501 and 502 are disposed in the shell 610, and are disposed near the head of the user A. Therefore, with this layout, the distance ΔL3 (=|L1−L2|) between the residual sound detecting microphone 501 and the ear of the user A can be reduced.

Also, in an ordinary recumbent state, the ear of the user A does not come close to the shell 610 on the head side. Therefore, the distance L2 between the ear A-1 of the user and the control speaker 401 disposed in the shell 610 can be kept large enough to prevent any worsening of noise.

Furthermore, since the connectors, harnesses, and so forth of the control speakers 401 and 402 and the residual sound detecting microphones 501 and 502 can be housed in the shell 610, there is no risk of disconnection when the seat 600 is moved.

Also, the control speakers 401 and 402 and the residual sound detecting microphones 501 and 502 are away from the rear face 600S of the seat 600. More specifically, as shown in FIGS. 7*b* and 7*c*, the control speakers 401 and 402 and the residual sound detecting microphones 501 and 502 are disposed at locations a specific height H1 from the rear face 600S. The specific height H1 can be set as needed, but is preferably set, for example, to be higher than the height of a pillow 620, and more preferably is set to be near the height (about 10 cm) of the ears of the user A whose head is resting on the pillow 620.

In this embodiment, the centers of the control speakers 401 and 402 and the residual sound detecting microphones 501 and 502 in the height direction are disposed at a location a specific height H2 from the rear face 600S. Specifically, the centers of the control speakers 401 and 402 and the residual sound detecting microphones 501 and 502 in the height direction are at substantially the same height. Consequently, at least part of the sound input faces of the control speakers 401 and 402 and the residual sound detecting microphones 501 and 502 will be exposed from the pillow 620.

The adverse effect of the pillow 620 can be reduced and the noise reduction effect can be improved by isolating the control speakers 401 and 402 and the residual sound detecting microphones 501 and 502 from the rear face 600S as discussed above.

Also, since the control speakers 401 and 402 and the residual sound detecting microphones 501 and 502 are disposed at about the same height, the distance between the control speakers 401 and 402 and the residual sound detecting microphones 501 and 502 can be reduced, which allows the output load of the control speakers 401 and 402 to be reduced.

The noise reduction device 100 is designed by taking into account the possibility that the user A may use the pillow 620, but the pillow 620 is not an essential constituent element for the noise reduction device 100.

The noise reduction effect obtained with the noise reduction device 100 shown in FIG. 7 will now be described through reference to FIG. 8.

Figure 8:
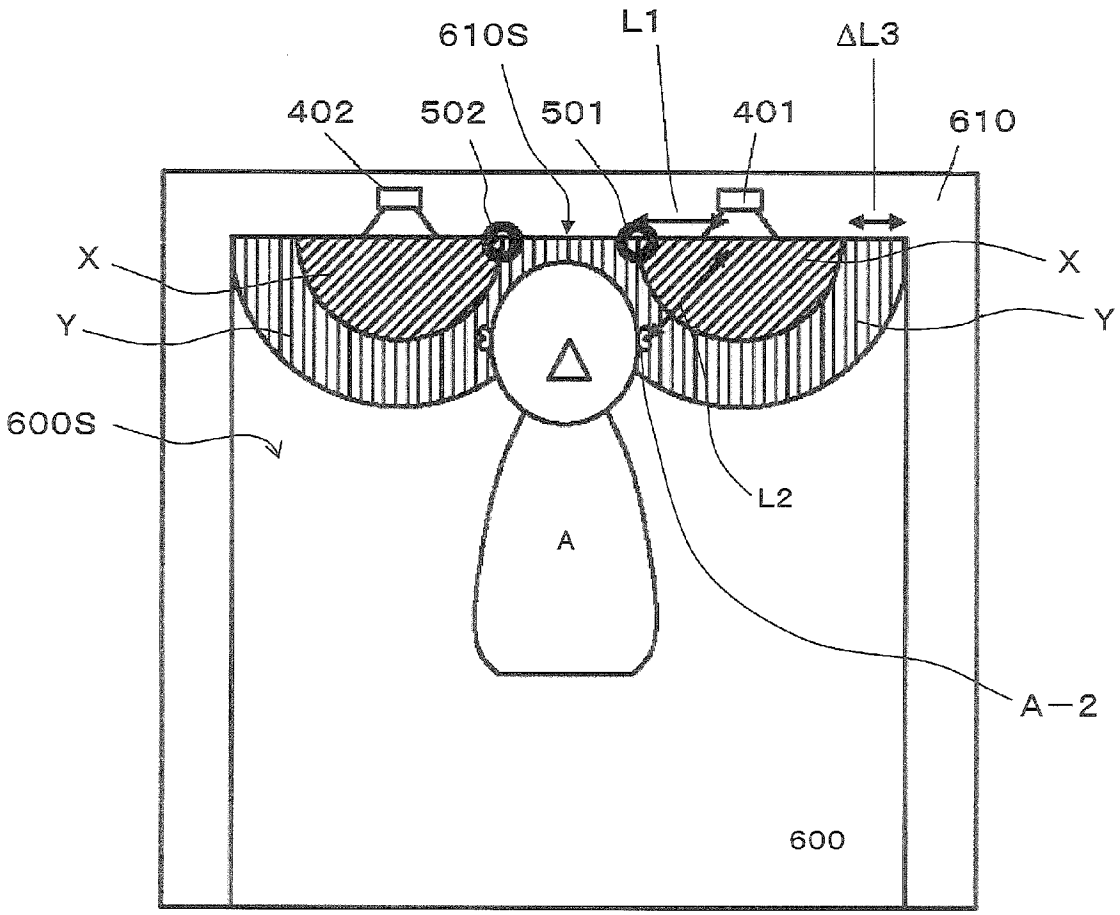
FIG. 8 is a diagram illustrating the action of the noise reduction device pertaining to an embodiment.

In FIG. 8, a case is assumed in which the distance L1 between the control speaker 401 and the residual sound detecting microphone 501 is approximately 15 cm, the distance L2 between the control speaker 401 and the ear A-1 of the user A is approximately 25 cm, and ΔLe is approximately 10 cm.

The regions X indicated by the diagonal hatching in FIG. 8 are regions in which L1 is greater than L2. If the user A moves so that the ear A-2 ends up going into the region X, there is the risk that noise heard by the user A will increase.

The distance from the top of an adult's head to the ear A-2 is approximately 15 cm. Accordingly, when the user A lies back on the rear face 600S of the seat 600, normally the ear A-2 of the user A will be at least 15 cm away from the inner top face 610S of the shell 610.

Therefore, as shown in FIG. 8, the amount of noise that enters the ear A-2 in the region X, where noise is more likely to increase, can be reduced by setting the distance L1 between the control speaker 401 and the residual sound detecting microphone 501 to approximately 15 cm.

The region Y indicated by the vertical hatching in FIG. 8 is a region in which a noise reduction effect is obtained over a frequency range of at least up to 567 Hz ($\approx V/(6\times\Delta L3)=340\times 100/(6\times 10)$), as is clear from the experiment results shown in FIG. 5. In general, the advantage of active noise control over a passive noise reduction means such as a sound absorbent material comes into play at about 500 Hz or less, so it can be seen that a sufficient noise reduction effect is obtained with the noise reduction device 100 shown in FIG. 8.

Other Embodiments

Next, another installation method for the noise reduction device 100 will be described through reference to FIG. 9. FIGS. 9A to 9C are all front views of the noise reduction device 100.

Figure 9B:
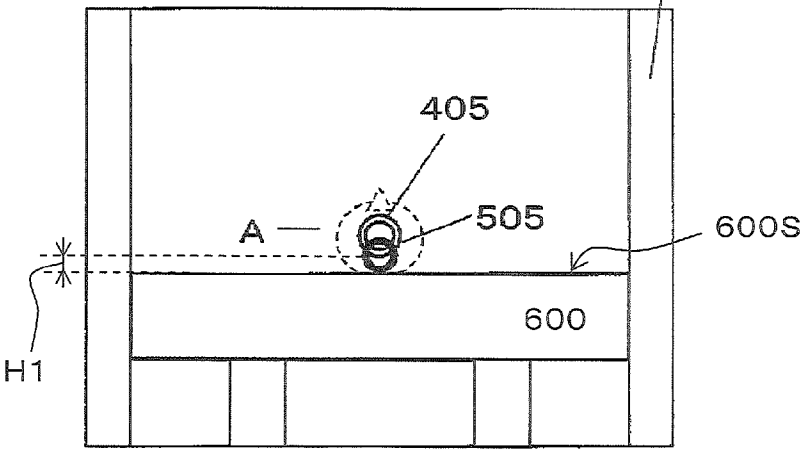
FIG. 9A, FIG. 9B and FIG. 9C are diagrams of the configuration of the noise reduction device pertaining to another embodiment.
Figure 9A:
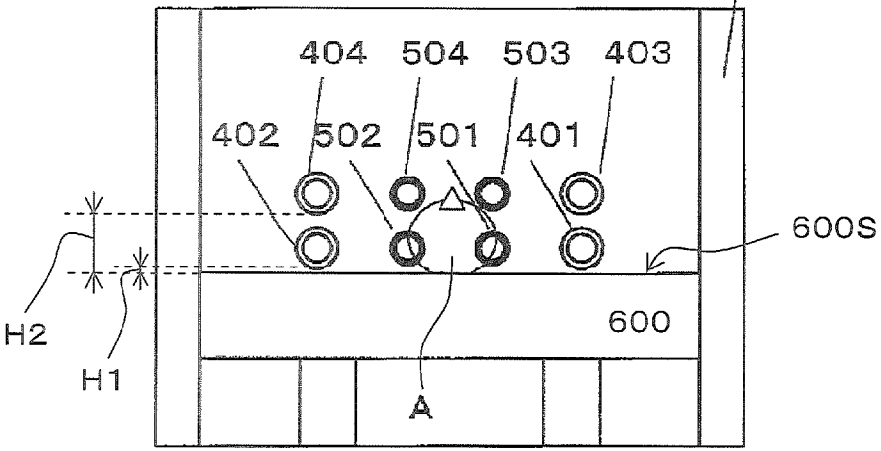

First, in the above embodiment, control speakers and residual sound detecting microphones were arranged in a single row inside the shell 610, but as shown in FIG. 9A, the control speakers and residual sound detecting microphones may be disposed in two rows, one above the other, inside the shell 610. This allows noise reduction to be achieved over a larger space by expanding the control speakers and residual sound detecting microphones in the height direction. More specifically, as discussed above, the control speakers 401 and 402 and the residual sound detecting microphones 501 and 502 of the lower row are disposed at locations a specific height H1 (such as 10 cm) from the rear face 600S. Accordingly, they are less likely to be covered by a pillow, and they are extremely close to the ears of the user A. Meanwhile, the control speakers 403 and 404 and the residual sound detecting microphones 503 and 504 of the upper row are disposed at locations at a height H2 (such as 25 cm), which is greater than the specific height H1, from the rear face 600S. Accordingly, if the user A should roller over while sleeping so that one ear comes up to a higher position, the control speakers 403 and 404 and the residual sound detecting microphones 503 and 504 can cancel out noise near that ear. Preferably, H2 is at least twice H1, that is, H2>2×H1. In this case, it has been experimentally confirmed that a sufficient noise reduction effect will be obtained at the height of the ear when the user has rolled over onto his side, by setting H1 to the height of the ear of the user A.

Also, in the above embodiment, the two control speakers 401 and 402 and the two residual sound detecting microphones 501 and 502 were disposed inside the shell 610, but as shown in FIG. 9B, one control speaker 405 and one residual sound detecting microphone 406 may be disposed inside the shell 610. Also, as shown in FIG. 9B, the positions of the lower ends of the control speaker 405 and the residual sound detecting microphone 406 may be different. At least part of the control speaker 405 and the residual sound detecting microphone 406 should be located at the specific height H1 from the rear face 600S. Here again, since at least part of the control speaker 405 and the residual sound detecting microphone 406 can be exposed from the pillow, there will be less weakening of the noise reduction effect by the pillow.

Figure 9C:
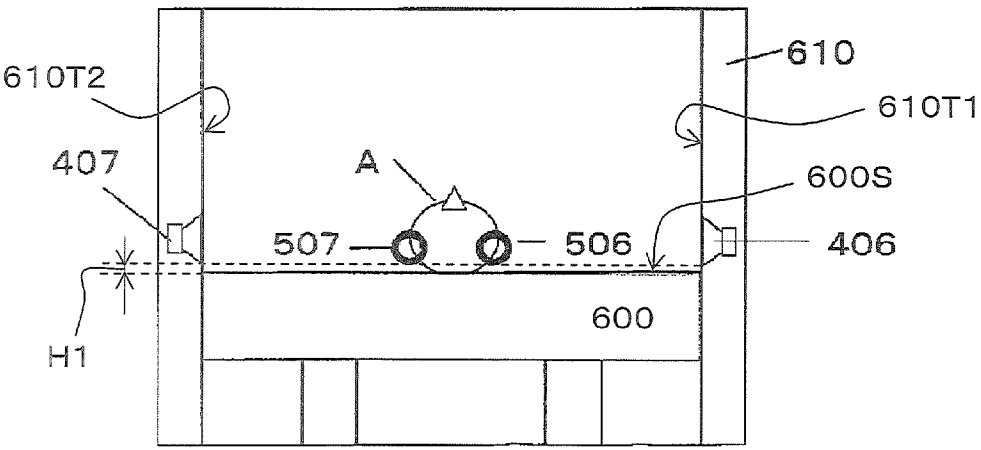

Also, in the above embodiment, the two control speakers 401 and 402 were housed inside the inner top face 610S of the shell 610, but as shown in FIG. 9C, control speakers 406 and 407 may be housed inside the first and second inner faces 610T1 and 610T2. Specifically, the control speakers 406 and 407 may be disposed inside side shells. Here again, the distance ΔL3 between the residual sound detecting microphones 506 and 507 and the ear A-1 of the user can be reduced, and a noise reduction effect will be obtained up to a high frequency.

Also, in the above embodiment, the control speakers 401 and 402 and the residual sound detecting microphones 501 and 502 were disposed uniformly on the left and right, using the center line AX in the width direction of the noise reduction device 100 as a reference, but this is not the only option. The control speakers 401 and 402 and the residual sound detecting microphones 501 and 502 may instead be offset to one side of the center line AX.

Also, in the above description, the combination of control speakers and residual sound detecting microphones was given for cases of one pair, two pairs, and four pairs, but there are no restrictions on the combinations of control speakers and residual sound detecting microphones.

Also, in the above description, a case of changing the seat 600 to a recumbent state by means of a reclining mechanism was described, but the seat 600 does not necessarily have to have a reclining mechanism, and may instead be in a fixed recumbent state.

Figure 10B:
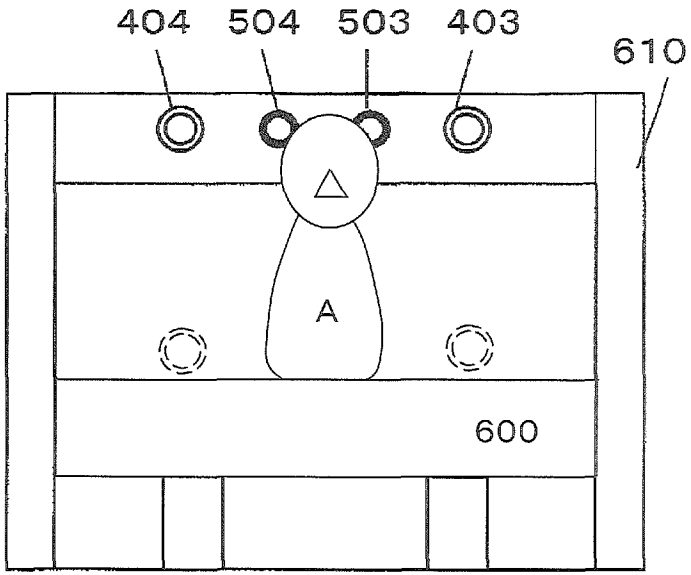
FIG. 10A and FIG. 10B are diagrams of the configuration of the noise reduction device pertaining to another embodiment.
Figure 10A:
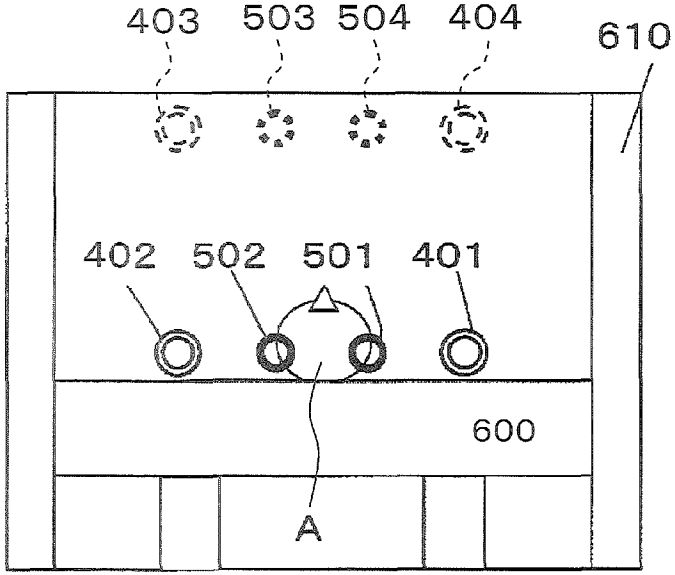

A method for using a plurality of control speakers and residual sound detecting microphones to cover everything from a recumbent state to an upright seated state will be described through reference to FIGS. 10*a* and 10*b*. As shown in FIG. 10A, when noise is reduced around the head of a user A who is in a recumbent state, the control speakers 401 and 402 and the residual sound detecting microphones 501 and 502 disposed at the lower part of the shell 610 are used. Also, as shown in FIG. 10B, the control speakers 403 and 404 and the residual sound detecting microphones 503 and 504 are used to reduce noise around the head of a user A who is seated upright. Consequently, it is possible to provide a noise reduction effect for a user A in a plurality of positions, without the risk of disconnection. A case was discussed here that corresponded to two states, namely, a recumbent state and an upright seated state, but it is obvious that other states can also be accommodated by disposing a plurality of combinations of control speakers and residual sound detecting microphones. Also, a single controller 200 may be switched, or a plurality of controllers 200 may be provided to matching the seating states.

What is claimed is:

1. A noise reduction device comprising:

a noise controller configured to produce a control sound signal for canceling out noise;

a control sound output component configured to output a control sound based on the control sound signal produced by the noise controller;

a residual sound detector configured to detect a residual sound produced by superposition of noise and the control sound outputted from the control sound output component, a shell which envelops at least part of a seat configured to support a user in a substantially lying posture, at least a pair of the control sound output components and at least a pair of the residual sound detectors are installed in the shell, wherein the pair of the control sound output components are disposed substantially uniformly in the width direction with a center line in the width direction of the seat as a reference, the pair of the residual sound detectors are disposed substantially uniformly in the width direction with the center line as a reference; and wherein a difference between a first distance and a second distance satisfies the formula $\Delta L3=V/(6\times f)$, the first distance corresponding to a distance from the control sound output component to the residual sound detector, the second distance corresponding to a distance from the control sound output component to a position of the user's ear, where $\Delta L3$ is the difference between the first distance and the second distance, V (m/sec) is a speed of sound in air, and f (Hz) is a limit frequency at which a noise reduction effect can be obtained.

2. The noise reduction device according to claim 1, wherein the second distance is greater than or equal to the first distance.

* * * * *